United States Patent [19]

Dobbertin

[11] Patent Number: 4,683,631

[45] Date of Patent: Aug. 4, 1987

[54] TOOL FOR SEATING FLOORING PANELS

[76] Inventor: Dennis Dobbertin, 141 Morris St., Apt. #1, Pewaukee, Wis. 53072

[21] Appl. No.: 908,399

[22] Filed: Sep. 12, 1986

Related U.S. Application Data

[63] Continuation of Ser. No. 759,869, Jul. 29, 1985, abandoned.

[51] Int. Cl.[4] ..... B25B 27/02

[52] U.S. Cl. ..... 29/278; 254/11

[58] Field of Search ..... 294/15, 92; 29/278, 29/275, 270; 254/11, 15, 17, 25

[56] References Cited

U.S. PATENT DOCUMENTS

| | | | |
|---|---|---|---|
| 195,412 | 9/1877 | Spurr et al. . | |
| 523,214 | 7/1894 | Kobler | 254/17 |
| 593,982 | 11/1897 | Carroll | 254/15 |
| 607,567 | 7/1898 | Jordan | 254/17 |
| 668,573 | 2/1901 | Beach | 254/17 |
| 721,681 | 3/1903 | Early | 254/15 |
| 847,272 | 3/1907 | Ayers . | |
| 1,309,734 | 7/1919 | Hemfling | 254/25 |
| 2,585,013 | 2/1952 | Johnson | 254/17 |
| 2,718,374 | 9/1955 | Kellenbarger | 254/17 |
| 2,884,035 | 4/1959 | Schut . | |
| 3,049,336 | 8/1962 | Proffit | 254/17 |
| 3,331,584 | 7/1967 | Schwartz . | |
| 3,939,546 | 2/1976 | Hernandez . | |
| 4,198,090 | 4/1980 | Gutman | 254/131.5 |
| 4,266,586 | 5/1981 | Brown . | |
| 4,621,791 | 11/1986 | Staskiewicz et al. | 254/17 |

*Primary Examiner*—Robert C. Watson

*Attorney, Agent, or Firm*—Glenn A. Busè

[57] ABSTRACT

The device for driving tongue and groove flooring panels into a mated or seated position for installation on floor joist has a weighted head including a rear face adapted to impact the outer edge of an elongated seated member resting on the floor joist and abutting an outer edge of the flooring panel to be installed. The head also includes an elongated opening for slidably receiving the upper portion of a floor joist. The head is moved back and forth along a floor joist to impact the seating member and drive the panel into a seated position by an elongated handle extending upwardly and rearwardly at an incline from the head. The handle is long enough to permit a workman to straddle a previously installed panel and the panel being installed while driving the latter panel into a fully seated position. The width of the groove and the head approximates the width or thickness of the floor joist. In one embodiment, the device can be used interchangably with standard wood floor joist and standard steel I-beam floor joist by making the width of the groove approximately the width of a flange on a standard steel I-beam floor joist and providing an insert which can be removably mounted in the groove and includes its own groove having a width approximating the thickness of a standard wood floor joist.

5 Claims, 4 Drawing Figures

TOOL FOR SEATING FLOODING PANELS

This application is a continuation of Ser. No. 759,869, now abandoned.

This invention relates to tools for driving mating tongue and groove members into a seated position and, more particularly, to such tools used for seating tongue and groove flooring panels.

Tongue and groove four foot by eight foot plywood panels are often used as flooring or sub-flooring for buildings, particularly residential buildings. The panels are laid on parallel floor joists and driven into seated engagement with a panel previously installed. A considerable force must be applied on the outer edge of a panel to drive it into a seated position.

One common procedure for installing such panels is for one workman to stand over the mating edges of the panels and guide the panel being installed into a seated position and while another workman stands on the panel being installed and drives it into place by pounding on a 2×4 seating member abutting the groove edge with a sledge hammer. This procedure can be quite hazordous because the workman using the sledge hammer must lean over uncovered joists and can accidently fall through them. Also, if the workman pounding on the seating member misses it, he can hit either himself or the other workman with the sledge hammer and cause injury.

Representative prior art tools used for installing and removing flooring are disclosed in the following U.S. Pat. Nos.:

| Patentee | Patent No. | Issue Date |
|---|---|---|
| Spurr et al. | 195,412 | September 18, 1877 |
| Ayers | 847,272 | March 12, 1907 |
| Schut | 2,884,035 | April 28, 1959 |
| Schwartz | 3,331,584 | July 18, 1967 |
| Hernandez | 3,939,546 | February 24, 1976 |
| Brown | 4,266,586 | May 12, 1981 |

The tool disclosed in U.S. Pat. No. 3,939,546 is specifically designed to minimize the above-noted difficulties. However, the driving head is a board which usually is not heavy enough for conveniently driving a "stubborn" panel into place. Also, in order to obtain a reasonable driving force, the board serving as the head must be absolutely square with the outer edge of the driven panel. The tool does not include anything to assist the workman in guiding the head into a squared position as the tool is moved back and forth during the driving operation. Furthermore, the tool does not include hand grips to assist a workman in applying a maximum pulling force.

SUMMARY OF THE INVENTION

An object of the invention is to provide a tool for driving mating panels, such as tongue and groove flooring panels, into a seated position for installation on floor joists, which tool includes a weighted head and is arranged to permit a single workman to set panels without having to lean over open joists.

Another object of the invention is to provide such a tool which includes means for guiding the weighted head into a squared position relative to the driven panel.

A further object of the invention is to provide such a tool including hand holds to assist the workman in applying a maximum pulling force on the weighted head.

A still further object of the invention is to provide such a tool which is adaptable for use in conjunction with both standard wooden floor joists and standard steel I-beam floor joists.

Other objects, aspects and advantages of the invention will become apparent to those skilled in the art upon reviewing the following detailed description, the drawing and the appended claims.

The invention provides a device for driving mating panels, such as tongue and groove flooring panels, into a seated position for installation on a parallel support members, which device includes a weighted head having a rear face adapted to impact the outer edge of an elongated seated member resting on the support members and abutting an outer edge of a panel and further includes an elongated handle extending upwardly and rearwardly at an incline from the head. The head includes an elongated opening or groove in the bottom portion for slidably receiving the upper portion of a support member and the handle is long enough to permit a user to stand behind the outer edge of a panel and move the head back and forth along a support member to impact the seating member and drive a panel into a seated position.

In one embodiment, a pair of axially spaced hand grips are provided on the upper portion of the handle for a user to grasp to facilitate back and forth movement of the head.

In another embodiment, another hand grip is provided on the lower portion of the handle for a user to grasp to assist in balancing the head during installation onto and removal from a support member.

The width of the groove can be made to approximate the thickness of a standard wood floor joist or the width of a flange of a standard steel I-beam floor joist. In one embodiment, the head can be used interchangably on both types of floor joist by making the width of the head groove approximately the width of the flange on a standard steel I-beam floor joist and providing an insert which can be removably mounted in the groove and include its own groove having a width approximating the thickness of a standard wood floor joist.

DESCRIPTION OF THE PREFERRED EMBODIMENTS

While the device can be used to set various types of boards or panels having mating joints and installed on parallel support members, it is particularly adaptable for use in setting 4 foot by 8 foot tongue and groove plywood flooring panels and will be described in connection with that use.

Figure 1:
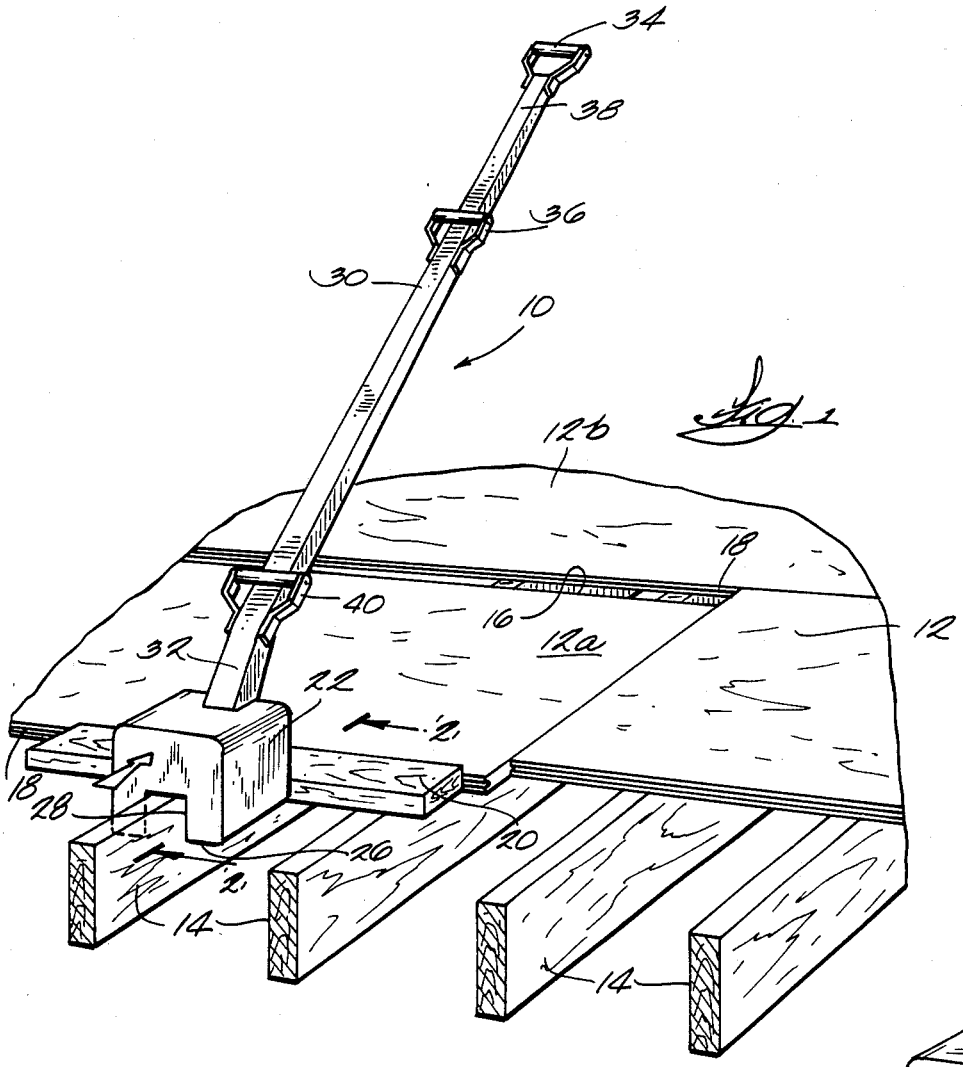
FIG. 1 is a prespective view of a flooring installation including standard wood floor joists, showing the device in position ready for use.

In FIG. 1, a device 10 embodying the invention is illustrated for use in setting 4 foot by 8 foot tongue and groove plywood flooring panels 12 on a parallel-spaced, standard wood floor joist 14. Flooring panel 12*a* to be seated with a previously installed flooring panel 12*b* is laid on the floor joist 14 with tne inner or tongue edge 16 facing the outer or grooved edge 18 of the installed flooring panel 12*b*. An elongated seating member 20, such as a length of a standard 2×4, is laid on the floor joist against the groove edge 18 of the flooring panel 12*a*.

The device 10 includes a weighted head 22 including a generally flat rear surface 24 for impacting the outer edge of the seating member 20. The head 22 has a bottom portion 26 including an elongated opening or groove 28 for slidably receiving the upper portion of a floor joist 14.

The device 10 also includes an elongated handle 30 includes a lower end 32 mounted on the head 22 and extends upperwardly and rearwardly at an incline from the head 22. The handle 30 is long enough so that a workman can stand with one foot on the installed panel 12*b* and one foot on panel 12*a* assist in guiding it into proper engagement with the installed panel 12*b* and move the head 22 back and forth along a floor joist 14 to impact the seating member 20 and drive the panel 12*a* to a seated position where its tongue is fully seated in the groove of the installed panel 12*b*.

The handle 30 includes a pair of hand grips 34 and 36 on the upper portion, one hand grip 34 mounted on the upper end 38 and the other hand grip 36 axially spaced therefrom. The hand grips 34 and 36 permit a workman to conveniently move the head 22 back and forth along a floor joist 14 and to apply a maximum pulling force on the head 22 for driving the panel 12*a* into the seated position. The handle 30 also includes a lower hand grip 40. The lower hand grip 40 is located relative to the head 22 to facilitate balancing the head during installation onto and removal from a floor joist.

The weight of the head 22 can vary, depending on the type and size of the boards or panels being installed. As a guide, for use with 4 foot by 8 foot tongue and groove plywood flooring panels, the weight of the head 22 usually is about 40 pounds.

Figure 2:
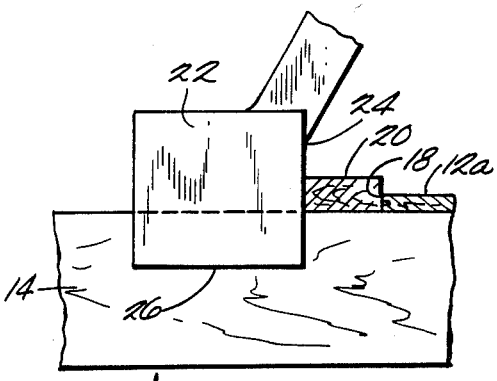
FIG. 2 is a side elevational view taken generally along line 2—2 in FIG. 1.

In the embodiment illustrated in FIGS. 1 and 2, the width of the groove 28 approximates, but is somewhat greater than, the thickness of a standard wood floor joist, for example, $1\frac{3}{4}$ inches. The lower end 32 of the handle 30 can be rigidly affixed on the head 22 as illustrated in FIGS. 1 and 2 or mounted on the head 22 in a suitable manner so that the angle of inclination can be adjusted to an angle most comfortable for individual workers. Also for the same purpose, the hand grips 36 and 40 can be removably mounted on the handle 30 in a suitable manner so that each can be mounted at two or more different locations along the handle 30.

Figure 3:
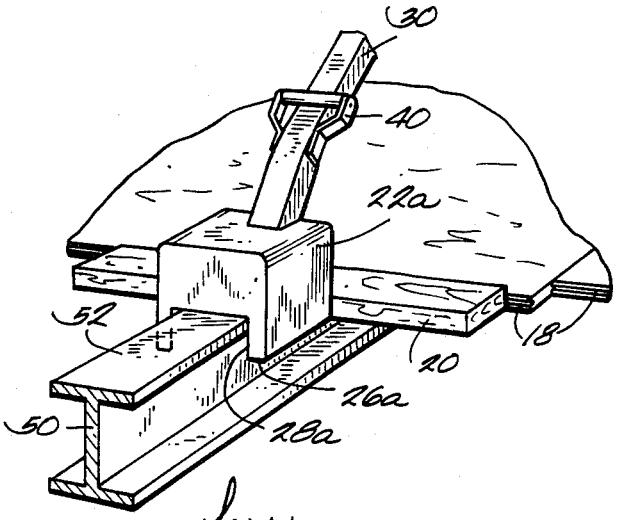
FIG. 3 is a fragmentary view similar to FIG. 1 showing the device in position ready for use on a floor installation including standard steel I-beam floor joist.

FIG. 3 illustrates an alternate embodiment in which the head 22*a* is arranged so that the device can be used to install flooring panels on standard steel I-beam floor joist 52. In this embodiment, the width of the elongated opening or groove 28*a* in the lower portion 26*a* of the head 22*a* approximates, but is somewhat larger than, the width of the flange 52 of the standard steel I-beam floor joist 50, for example, about $3\frac{1}{2}$ inches. Otherwise, the construction of the device can be the same as in the embodiment illustrated in FIGS. 1 and 2.

Figure 4:
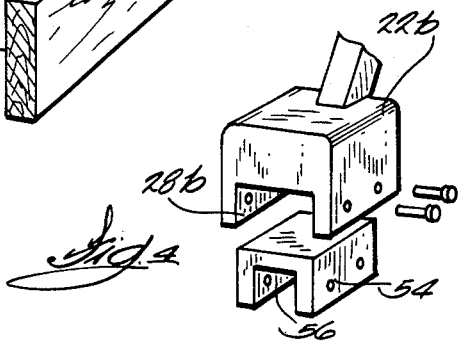
FIG. 4 is an exploded, fragmentary view of an alternate embodiment of the device which is adapted for use interchangably with standard wood floor joist and standard steel I-beam floor joist.

FIG. 4 illustrates an alternate embodiment in which the head 22*b* is arranged so that the tool can be used interchangably with standard wood floor joist and standard steel I-beam floor joist. In this embodiment, the head 22*b* includes an elongated opening or groove 28*b* having a width which approximates the width of the flange of a standard steel I-beam floor joist similar to the embodiment illustrated in FIG. 3.

The device 10 further includes a removably mounted insert 54 which fits inside the groove 28*b* and has its own elongated opening or groove 56. The width of the insert groove 56 approximates, out is somewhat larger than, the thickness of a standard wood floor joist similar to the groove 28 in the emboidment illustrated in FIGS. 1 and 2. Thus, the tool can be used with standard steel I-beam floor joist when the insert 54 is removed and can be used with standard wood floor joist when the insert 54 is installed. The insert 54 is removably mounted in the groove 28*b* by suitable fasteners, such as bolts 56 or the like.

If desired, the walls of the groove 28 in the head and the groove 56 in the insert can be coated with a low friction material, such as a Teflon-based coating composition, to enhance the sliding action of the head along a floor joist.

From the foregoing description, one skilled in the art can easily ascertain the essential characteristics of the invention and, without departing from the spirit and scope thereof, make various changes and modifications to adapt it to various usages.

I claim:

1. A device for driving mating tongue and groove panels into a seated position for installation on parallel support members, said device including a weighted head substantially heavier than a length of scrap lumber and having a generally flat, vertically extending rear face adapted to impact the outer edge of an elongated seating member resting on the support member and abutting an outer edge of the panel, said head including a bottom portion having an elongated groove for slidably receiving the upper portion of a support member and cooperating therewith to guide free back and forth movement of said head along the support member, said rear face extending generally perpendicularly to the direction of movement of said head;

an elongated handle having a lower end mounted on said head, said handle extending upwardly and rearwardly at an incline from said head and having a length sufficient to permit a user to stand in a position behind the outer edge of a panel and move said head back and forth along a support member;

a pair of axially-spaced hand grips on the upper portion of said handle for grasping by a user to push said head away from the seating member and to forceably pull said head toward the seating member to impact the seating member and drive a panel into a seated position; and a hand grip located on the lower portion of said handle for grasping by a user to assist in balancing said head during installation onto and removal from a support member.

2. A device according to claim 1 wherein said groove has a width approximating the thickness of a standard wooden floor joist.

3. A device according to claim 1 wherein said groove has a width approximating the width of a flange of a standard steel I-beam floor joist.

4. A device according to claim 3 including an insert adapted to be mounted in said groove and including an elongated opening having a width approximating the thickness of a standard wood floor joist.

5. A device for driving mating tongue and groove panels into a seated position for installation on parallel standard wood floor joists or a standard steel I-beam joist, said device including a weighted head having a generally flat, vertically extending rear face adapted to impact the outer edge of an elongated seating member resting on the floor joist and abutting an outer edge of the panel, said head including a bottom portion having an elongated groove for slidably receiving the upper portion of a floor joist and cooperating therewith to guide free back and forth movement of said head along the joist, said rear face extending generally perpendicularly to the direction of movement of said head;

an elongated handle having a lower end mounted on said head, said handle extending upwardly and rearwardly at an incline from said head and having a length sufficient to permit a user to stand in a position behind the outer edge of a panel and move said head back and forth along a floor joist to impact the seating member and drive a panel into a seated position, and said groove having a width approximating the width of a steel I-beam floor joist and said device further including an insert adapted to be mounted in said groove and including an elongated opening having a width approximating the width of a standard wood floor joist.

* * * * *